United States Patent [19]

Cuthbert

[11] Patent Number: 4,914,832

[45] Date of Patent: Apr. 10, 1990

[54] GRIP DEMOISTURIZER

[76] Inventor: James A. Cuthbert, 125 Cumberland Cir. East, Longwood, Fla. 32779

[21] Appl. No.: 308,304

[22] Filed: Feb. 8, 1989

[51] Int. Cl.[4] ..... B08B 15/04; F26B 5/16

[52] U.S. Cl. ..... 34/9; 34/95; 118/3; 118/309; 15/104.92; 401/9; 401/49; 427/18; 427/202; 427/180

[58] Field of Search ..... 273/73 R, 75, 81 R, 273/32 B, 32 R, 325 S; 427/180, 202; 118/309, 3; 401/9, 4, 292; 366/332; 15/104.92, 104.93, 104.94; 34/107, DIG. 1, 95

[56] References Cited

U.S. PATENT DOCUMENTS

| | | | |
|---|---|---|---|
| 320,593 | 6/1885 | Sherwood | 34/95 |
| 1,714,346 | 5/1929 | Carelton . | |
| 1,952,502 | 3/1934 | Kinkead | 118/309 |
| 2,241,947 | 5/1941 | Goodwin | 34/95 |
| 3,224,029 | 12/1965 | Domingos | 15/104.92 |
| 3,645,008 | 2/1972 | Delsack | 273/75 |
| 4,108,436 | 8/1978 | Masi | 273/75 |
| 4,237,641 | 12/1980 | Gupton | 43/25 |
| 4,282,891 | 8/1981 | Duceppe | 15/104.94 |
| 4,662,415 | 5/1987 | Proutt | 150/52 G |

*Primary Examiner*—Richard J. Johnson
*Attorney, Agent, or Firm*—Warren L. Franz

[57] ABSTRACT

A grip demoisturizing device for a sports racquet, or the like, has a normally closed tubular container containing a moisture absorbing powder and a self-closing, elastically yielding flap valve for admitting the grip into the container. A described embodiment has an apertured tubular partition located coaxially within the container and spaced therefrom by apertured discs, with powder being stored in an annular region and the diameter of the partition being chosen so as to provide a "pump" and "swab" action to provide an additional measure of neatness in dispensing the powder onto the grip.

20 Claims, 1 Drawing Sheet

FIG. 1
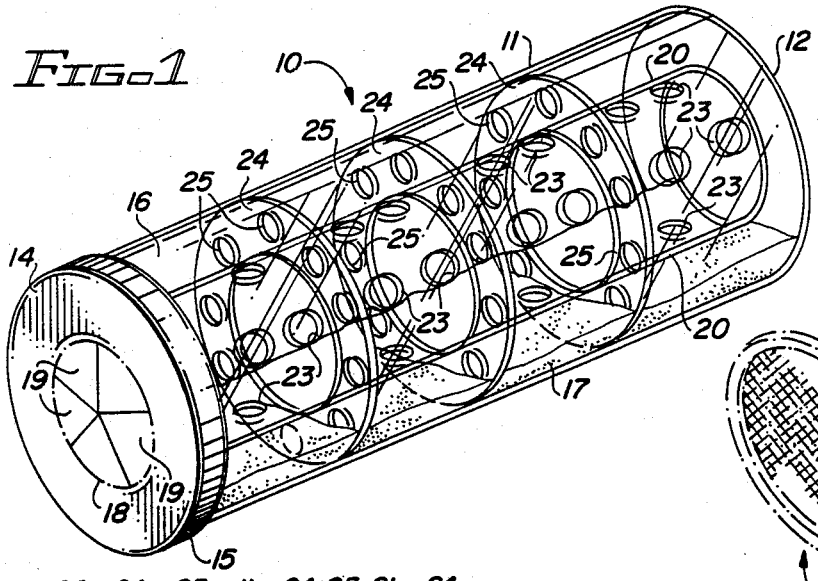
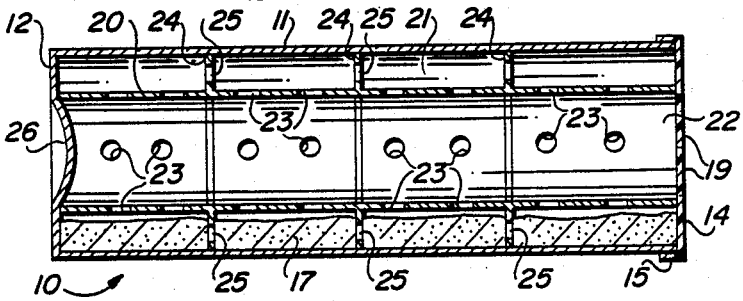
FIG. 2A
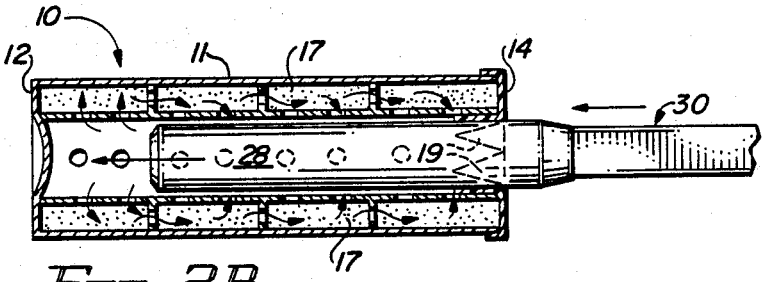
FIG. 2B
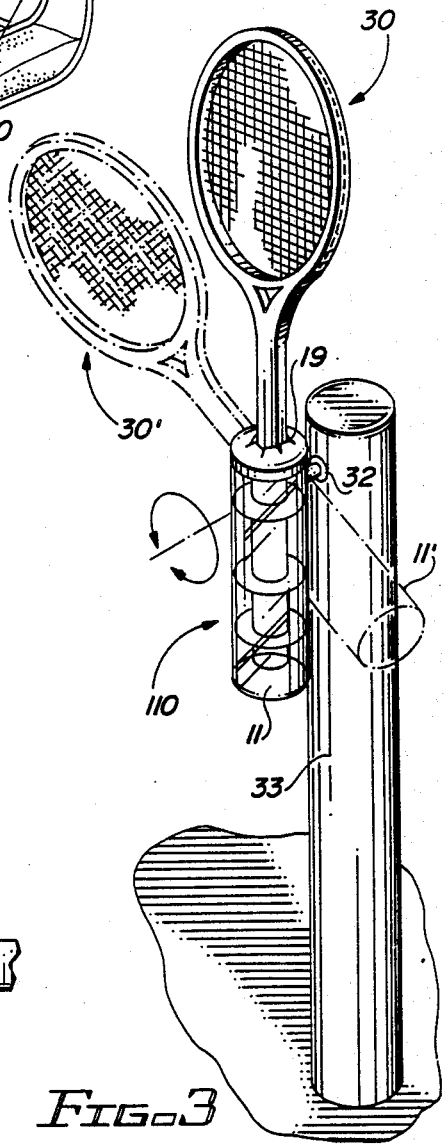
FIG. 3
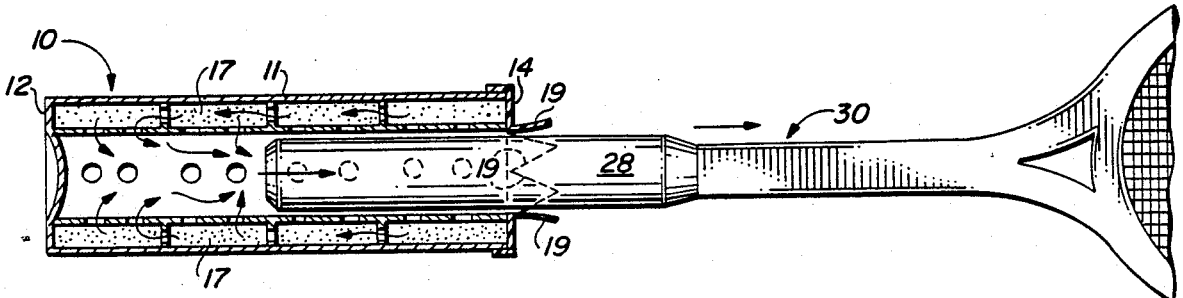
FIG. 2C

GRIP DEMOISTURIZER

This invention relates to a device for applying a moisture absorbent powdery substance to a grip, such as the grip of a sports racquet, handle of a golf club, or the like; and, in particular, to a self-closing container for neatly storing and dispensing such a moisture absorber onto the grip or handle.

BACKGROUND OF THE INVENTION

During active racquet sports play, such as during tennis, squash, badminton, lacrosse, etc., the grips of the racquets frequently become soaked with sweat transferred from the hands of participants which may make the grip slippery or otherwise interfere with the grasping thereof. A similar situation arises in bat sports like baseball, cue stick sports like billiards and club sports like golf. The same problem can occur also with horse whips and fishing rods. In each case, an elongated handle or stock (hereafter "grip") that is manually gripped by a user becomes covered with sweat and it is a desirable objective to remove the same.

Accumulated sweat may be removed from time to time by blotting the same with a terry cloth or other towel material. Alternatively, a continuous moisture absorbing action can be obtained by applying talc, rosin, deliquescent salt, sawdust, or other desicant or moisture absorbing material in powder or particulate form (hereinafter "powder") over the grip to capture the sweat and improve frictional contact during usage.

A problem with the application of a moisture absorbing powdery substance to a grip shaft is the difficulty of neatly containing such materials and the general messiness of such materials during application. A usual way of carrying such powdery substances is in a container having normally closed apertures that are opened to spill a quantity of such material onto the hands for rubbing onto the grip or handle. Dispensing is hard to control and materials such as talcium tend to puff up into clouds when expelled through the apertures. It is common to dispense grip demoisturizing agents like ground chalk by means of a cloth impregnated with the same and often stored between uses in a plastic bag or other closed container. Even such powder impregnated cloths will normally emit unwanted puffs of material when wiped around the grip surfaces, though an initial shaking action is avoided.

SUMMARY OF THE INVENTION

It is an object of the present invention to provide a device for applying a moisture absorbing powder to a grip of a sports racquet, or the like, in a neat and convenient manner which minimizes unwanted clouding and spreading of the powder to unintended surfaces.

In accordance with the invention a device for applying a moisture absorbing substance to the grip of a sports racquet, or the like, comprises a container defining a normally closed chamber for storage of a quantity of moisture absorbent powder, and self-closing valve means located on the container for admitting the grip or handle into the interior of the container for application of a portion of the contained powder thereto. The valve means functions to open for admission of the grip and close upon its withdrawal, thereby preventing dispensing of the powder other than by attachment to the inserted surfaces of the grip.

A preferred embodiment of the invention, described in greater detail below has a normally closed tubular container with an internal, smaller diameter tubular partition located coaxially therein and defining annular and central partitioned regions within a closed chamber. The top of the container has valve means in the form of adjacently disposed contacting flaps which yield elastically when depressed by the base of a grip to uncover an opening into the container through which to admit the grip into the central chamber region. The tubular partition is apertured to communicate a portion of a quantity of moisture absorbent powdery substance stored in the annular region through the partition into the central region and onto the inserted surfaces of the grip. Removal of the grip from the container restores the flaps to their container closing position.

The partition is preferably dimensioned, as described below, in close tolerance with the dimensions of the grip so that a "pump" and "swab" action occurs upon insertion and withdrawal, respectively, of the grip to assist in dispensing from and recapture to the annulus of the powder.

BRIEF DESCRIPTION OF THE DRAWINGS

An embodiment of the invention has been chosen for purposes of illustration and description, and is shown in the accompanying drawings, wherein:

FIG. 1 is a perspective view of a preferred embodiment of the invention presented as a demoisturizer for the grip of a tennis racquet handle;

FIGS. 2A–2C are schematic longitudinal section views of the embodiment of FIG. 1, helpful in understanding an advantageous operating feature of the embodiment of FIG. 1; and FIG. 3 is a perspective view of an implementation of the embodiment of FIG. 1 in the environment of a tennis court.

Throughout the drawings like elements are referred to by like numerals.

DESCRIPTION OF A PREFERRED EMBODIMENT

The principles of the invention are described by way of example in their application to an illustrative device for applying moisture absorbing substance to the grip of a tennis racquet. The understanding of the principles thus applied should make possible their application elsewhere.

As shown in FIG. 1, an exemplary grip demoisturizer device 10 has a container 11 in the form of a transparent plastic tubular housing with a closed circular base 12 and an open circular top sealed by means of a cap 14 having a peripheral circumferentially projecting flange 15 which is brought over the external surface of the container 11 perimetally adjacent the top. The capped container 11 thus defines a normally closed internal chamber 16 for storage of a quantity of a moisture absorbent powdery substance, such as talcum 17, whose application to the grip end of a tennis racquet will absorb sweat therefrom and improve the manual grasping thereof.

A central area 18 (shown by dot and dashed lines in FIG. 1) of the cap 14 is provided with valve means in the form of adjacently disposed flaps 19 to provide a self-closing mechanism for admission of the tennis racquet grip into the interior of the container 11. In the illustrated embodiment, the flaps 19 are formed by making a plurality of radial cuts from the center of the cap 14 an equal distance partway out to the flanged edge of the cap 14. The material of cap 14 is chosen to impart an elastic quality under deformation to the flaps 19, so that the flaps will yield elastically to uncover an opening bounded by the area 18 when depressed inwardly towards the chamber 16 by the base of a grip, as further detailed below.

To increase the neatness and control of the powder storage and dispensing operation of the demoisturizer 10, as shown in FIG. 1, a smaller diameter tubular partition 20 is located centrally within the chamber 16, coaxially with and for the full length of the container 11. The partition 20 serves to divide the closed chamber 16 into an annular region 21 and a central core region 22 (see FIG. 2A). For reasons that will become apparent from the discussion below, the diameter of the partition 20 (and, thus, the diameter of the core region 22) is advantageously chosen to be the same as the diameter of the area 18 and just slightly larger than the diameter of the grip onto which application of the powder 17 is desired.

The powder 17 is preferably initially stored in the annulus 21, with apertures 23 provided over the length of the partition 20 serving to communicate that powder into the core region 22 on demand. A plurality of toroidal spacers or discs 24 provided with powder communicating apertures 25 serve to impart additional rigidity to the container 11 and maintain the centralized position of the partition 20 relative to the circumferential walls of the container 11.

The container 11 for use as a tennis racquet grip demoisturizer device 10 may suitably correspond in general configuration to the structure of a plastic three tennis ball container, now presently known, the container 11 being similar in dimension and material to the main open-topped ball receiving portion and the cap 14 being similar to the reattachable plastic tennis ball container cap. Such known ball can structures commonly have central, inwardly protruding dimples 26 (see FIG. 2A) that can be adapted to maintain the centrality of the inner extent of an insertable/removable form of partition member 20. The rings 24 can be dimensioned relative to the internal diameter of the container 11 and fixed at longitudinally spaced intervals along the partition 20, so that the partition 20 and attached rings 24 can be inserted as an assembly into the interior of the container 11 and maintained therein by virtue of a close fit between the outer circumferential edge of the discs 24 and the inner diameter of the container 11. One possible arrangement is to have the partition and discs housed in a plastic wrap outer sheath, or the like, with a full reload of powder contained in the region between the outer diameter of the partition 20 and the inside of the wrap, thus providing an expendable powder cartridge insert element.

FIGS. 2A–2C show, by means of a series of cross-sectional schematic views, the operation of an advantageous feature of a preferred implementation of the device 10 in which the inside diameter of the partition 20 closely matches the outside diameter of a grip 28 of a tennis racquet 30. FIGS. 2A–2C show a device 10 as in FIG. 1 having a tubular partition 20 coaxially located within the container 11 to define a normally closed internal chamber having annular and core regions 21, 22. FIG. 2A shows the device 10 in its closed valve position with a quantity of powdery substance, such as talcum 17, received within the annular region 21. When the base of a grip 28 of a racquet 30 is directed at the central area 18 (see FIG. 1) of the cap 14 (as shown by the arrow in FIG. 2B), the flaps 19 yield axially and radially to admit the grip 28 coaxially into the core region 22. Where close tolerance exists between the outside diameter of the grip 28 and the inside diameter of the partition 20, movement of the racquet 30 into the device 10 will force air from portions of the core region 22 below the base of the grip 28 outwardly into the annular region 21 and up toward the top 14 of the container 11 (i.e. toward the shank restriction of the racquet 30). This lower core region pressurizing action "pumps" an amount of the powder 17 from its storage position in the annulus 21 through the apertures 23 and dispels it as a cloud onto the grip portion 28 of the racquet 30. Subsequent withdrawal of the racquet 30 from the container 11, as shown by the arrow in FIG. 2C, decreases pressure in the core region 22 below the base of the grip 28 and causes a reverse flow of air in the container that "swabs" the residue of powder 17 brought into the core 22 back out and into the annular storage region 21. This alternate pumping and swabbing action adds an additional measure of neatness to the powder dispensing process. When the racquet 30 has been completely withdrawn from the container 11, the flaps 19 will resume their normally closed position to block further dissemination of the powder 17 out of the chamber 16.

FIG. 3 shows an example implementation of a grip demoisturizer device 110 in a tennis court environment. A normally closed container 11 having self-closing valve means 19 for admitting the grip of a tennis racquet 30 contains a quantity of moisture absorbent powder for application thereon. The implementation 110 may be constructed, as desired, with or without a partition 20 and discs 24; however, a swivel bracket 32 is provided attaching an intermediate point of the container 11 to a post 33 (e.g., a tennis net supporting post) for pivotal rotation of the container 11 together with the racquet 30 about a horizontal axis. An amount of powder can thus be applied to the grip of the racquet 30 by inserting the grip against the valve means 19 and into the container 11 and then pivoting the container about the swivel 32 by turning the racquet to a position 30′ (shown by dot-dashed lines) in order to agitate the powder in the container 11 onto the grip. The container 11 can be weighted or the swivel 32 provided with a biasing mechanism to return the container 11 to an upright position after removal of the tennis racquet 30.

It will be appreciated by those skilled in the art to which the invention relates that the forgoing detailed description of preferred embodiments of the invention has been made for illustrative purposes only and not by way of limitation. In particular, it will be appreciated that dimensional and configurational changes may be made to conform to the structures of particular grips. For example, for use with a bow grip which is located centrally on an elongated bow, a valve means 19 can be accommodated at both ends of the container 11 to enable the grip to be received within the chamber 16. It will also be appreciated that various other substitutions and modifications may also be made thereto, without departing from the spirit and scope of the invention as defined by the claims below.

What is claimed is:

1. A device for applying a moisture absorbent powdery substance to an elongated grip, such as the grip of a sports racquet or the like, comprising:

a container defining a normally closed internal chamber;

a quantity of moisture absorbent powder stored within said chamber; and self-closing valve means cooperating with said container for opening said chamber to admit the grip for inserting therein, and for reclosing the same upon withdrawal of the grip to prevent dispensing of the powder out of said chamber other than by attachment to inserted surfaces of the grip.

2. A device as in claim 1, further comprising means located within said chamber for partitioning said chamber into first and second regions, said powder being stored within said first region and said valve means functioning to admit the grip for insertion into said second region; and means for communicating powder from said first region to said second region when the grip is inserted within the second region.

3. A device as in claim 2, further comprising spacer means for maintaining the position of said partitioning means within said chamber.

4. A device as in claim 1, in combination with a post for use adjacent a game court, and further comprising swivel means mounting said device for manual rotation about a pivotal axis relative to said post to cause agitation of said powder when the grip is inserted in said chamber to assist in application of said powder to said inserted surfaces.

5. A device for applying a moisture absorbent powdery substance to an elongated grip, such as the grip of a sports racquet or the like, comprising:

a tubular container defining a normally closed internal cylindrical chamber having top, bottom and side walls;

a tubular partition located centrally within said chamber in spaced position from said side walls and partitioning said chamber into annular and central regions;

a quantity of moisture absorbent powder stored within said annular region;

self-closing valve means cooperating with said top of said chamber for opening said central region to admit the grip for insertion therein, and for reclosing the same upon withdrawal of the grip to prevent dispensing of the powder out of said chamber other than by attachment to inserted surfaces of the grip; and means for communicating powder from said annular region to said central region when the grip is inserted within said central region.

6. A device as in claim 5, wherein said partition is apertured for communicating powder from said annular region to said central region.

7. A device as in claim 6, further comprising at least one spacer located within said annular region for maintaining the position of said partition within said chamber.

8. A device as in claim 7, wherein said spacer comprises a toroidal disc whose outside diameter is generally equal to the inside diameter of said cylindrical chamber and whose inside diameter is generally equal to the outside diameter of said partition; and wherein said partition has an axial length generally equal to an axial length of said chamber.

9. A device as in claim 8, wherein said disc is apertured for communicating powder through said disc.

10. A device as in claim 5, for use in combination with an elongated grip of generally circular cross-section and having a maximum section diameter, wherein said tubular partition of said device has an inside diameter generally equal to said maximum grip section diameter.

11. A device of applying a moisture absorbent powdery substance to an elongated grip, such as the grip of a sports racquet of the like, comprising:

a tubular container having top, bottom and side walls, and defining a normally closed internal cylindrical chamber;

a tubular partition located coaxially within said chamber in spaced position from said side walls and partitioning said chamber into annular and central core regions;

a quantity of moisture absorbent powder stored within said annular region; and a plurality of flap members disposed centrally on said top and being dimensioned, configured and adapted to yield elastically when depressed by a base of the grip to open said container only at said central core region to admit the grip for insertion into said central core region, and to rebound when said base is withdrawn to reclose said container to prevent dispensing of said powder out of said chamber other than by attachment to inserted surfaces of the grip;

said partition being apertured for communicating powder from said annular region to said central core region when the grip os inserted within said central core region.

12. A device as in claim 11, further comprising a plurality of spacer members in the form of toroidal discs extending radially outward peripherally of said partition at axially spaced locations therealong and serving to maintain said partition coaxially within said chamber.

13. A device as in claim 12, wherein said discs are apertured for communicating powder therethrough.

14. A device as in claim 13, wherein said flap members comprise portions of said top wall formed by making equal, angularly spaced radial cuts from the center of said top wall, said cuts having a radial dimension generally equal to one-half the inside diameter of said partition.

15. A device as in claim 14, for use in combination with an elongated grip of generally circular cross-section and having a maximum section diameter, wherein said tubular partition of said device having an inside diameter generally equal to said maximum section diameter.

16. A method for applying a moisture absorbing substance to the grip of a sports racket or the like, comprising:

storing a quantity of moisture absorbent powder within a normally closed internal chamber of a container having a self-closing valve cooperating therewith;

opening said valve by bringing an end of said grip against said valve;

inserting said grip into said chamber through said opened valve;

attaching an amount of said stored powder onto said grip while said grip is inserted within said chamber; and withdrawing said grip from said chamber and away from said valve to reclose said valve and said chamber, whereby dispensing of said powder out of said chamber is prevented other than by attachment to inserted surfaces of said grip.

17. A method as in claim 16, wherein said storing step comprises storing said powder within a first region of said chamber defined by a partition located therein which partitions said chamber into said first and a second region; wherein said inserting step comprises inserting said grip into said second region; and wherein said attachment step comprises communicating said amount of powder from said first to said second region when said grip is inserted within said chamber.

18. A method as in claim 17, wherein said communicating step occurs at least partly in response to said inserting step.

19. A method as in claim 18, further comprising a step of communicating a residue of powder from said second to said first region at least partly in response to said withdrawing step.

20. A method as in claim 19, wherein said container is tubular; said chamber is cylindrical; said partition is tubular, apertured and centrally located within said chamber to define said first region as an annular region and said second region as a central region; and said communicating steps in response to said inserting and withdrawing steps occur because of generally equal dimensioning of a cross-sectional area of said inserted grip and an inside diameter of said partition.

* * * * *